US005259317A

United States Patent [19]

Lips

[11] Patent Number: 5,259,317

[45] Date of Patent: Nov. 9, 1993

[54] HOLLOW CHARGE WITH DETONATION WAVE GUIDE

[75] Inventor: Hendrik Lips, Dusseldorf, Fed. Rep. of Germany

[73] Assignee: Rheinmetall GmbH, Ratingen, Fed. Rep. of Germany

[21] Appl. No.: 700,924

[22] Filed: Nov. 2, 1984

[30] Foreign Application Priority Data

Nov. 12, 1983 [DE] Fed. Rep. of Germany ..... 3341052

[51] Int. Cl.[5] ..... F42B 1/02

[52] U.S. Cl. ..... 102/307; 102/309; 102/476

[58] Field of Search ..... 102/306, 307, 308, 309, 102/476

[56] References Cited

U.S. PATENT DOCUMENTS

| | | | |
|---|---|---|---|
| 3,027,838 | 4/1962 | Meddick | 102/309 |
| 3,437,036 | 4/1969 | Franzen et al. | 102/306 X |
| 3,561,361 | 9/1971 | Kessenich et al. | 102/307 |
| 3,736,875 | 6/1973 | Bucklishch | 102/309 |
| 3,802,342 | 4/1974 | Berlot et al. | 102/309 |
| 3,948,181 | 4/1976 | Bergstrom | 102/307 X |
| 4,498,367 | 2/1985 | Skolnick et al. | 102/306 X |
| 4,594,946 | 6/1986 | Ringel | 102/307 |
| 4,594,947 | 6/1986 | Aubry et al. | 102/309 X |

FOREIGN PATENT DOCUMENTS

| | | |
|---|---|---|
| 1220306 | 12/1964 | Fed. Rep. of Germany . |
| 1157260 | 3/1966 | Fed. Rep. of Germany . |
| 3341052 | 11/1983 | Fed. Rep. of Germany . |
| 1469182 | 3/1977 | United Kingdom . |

*Primary Examiner*—Peter A. Nelson

*Attorney, Agent, or Firm*—Spencer, Frank & Schneider

[57] ABSTRACT

A warhead having hollow charge, such as a bomblet as well as a large caliber armor-piercing projectile has an improved detonation wave guide arrangement which preferably produces a high pyrophoric effect at target impact.

The detonation wave guide itself is made of an incendiary-active (flamable) material, whereby a strong exothermal reaction is released by shock waves at target impact in the binding substances which form the wave guide. By exclusively initiating this exothermal reaction and incendiary effect by means of shock waves a rapid and simple introduction of the reaction in a few microseconds is achieved. The binding substance consists of metal particles and gases embedded in matrix. These metal particles have a high combustion enthalpy and the matrix is made of an organic polymer. The shock waves cause a decomposition of the metal particles of the matrix and a simultaneous temperature increase and a chemical reaction is triggered, whereby by means of the reaction products the temperature is further increased and by virtue of the release of large heat energy even poorly flamable substances are burned.

6 Claims, 1 Drawing Sheet

HOLLOW CHARGE WITH DETONATION WAVE GUIDE

BACKGROUND OF THE INVENTION

The invention relates to a hollow charge having a detonation wave guide arranged on a rotational axis.

The conventional detonation wave guides, such as for example disclosed in German Patent No. 1 220 306, are made exclusively out of synthetic material or another inert material. Such known arrangements of detonation wave guides have heretofore had the sole object of increasing the effect of the hollow charge, in particular its penetration capability at targetimpact. The conventional detonation wave guide can be mounted between the hollow charge cladding and the rear end of the projectile, for example it can be fully embedded in the explosive material or, in accordance with an arrangement disclosed in German published application No. 15 71 260, it can be arranged centrally in a cylindrical pipe forming the cladding of the hollow charge.

SUMMARY OF THE INVENTION

It is a general object of this invention to provide a detonation wave guide for a hollow charge which constitutes an improvement over the conventional detonation wave guides of this type.

More specifically, it is an object of this invention to provide a detonation wave guide which renders a high pyrophoric effect at the target.

The hollow charge of this invention distinguishes itself in that in addition to the known output increasing detonation wave guiding of the detonation guide, the latter is no longer passive (inert) but active, in particular combustion-active or incendiary-active at the target thereby participating in the target destruction, whereby while maintaining substantially identical constructional shapes and sizes additional means for an incendiary effect, in particular an incendiary effect in the region of the target, can be dispensed with.

By applying such hollow charge, preferably in the form of bomblets, it is possible to combat optimally semi-hard targets such as protective armor, artillery positions and transportation trucks by means of a broadly fanned incendiary-active secondary effect.

The pyrophoric effect at the target is achieved by utilizing a new technology. The technology is based on a strong exothermal reaction, which releases the detonation wave guide by means of shock waves of the detonating material, which wave guide consists of a reactive binding material. Thereby it is possible to advantageously also burn substances which are difficult to burn, for example, Diesel fuel. In view of the fact that the initiation of the incendiary effect of the compound material is exclusively engendered by the shock waves, there can be achieved the desired reaction in a few micro seconds in a simple and rapid manner.

A further advantage of the compound material resides in its high stability relative to temperature and atmospheric influences, whereby a significant safety in handling is achieved. Thereby further adavantages result in view of the simple, precise and rapid manufacturing possibilities of the detonation wave guide, whereby in particular manufacturing processes requiring modest stress inputs, for example a pressing process can be utilized.

On the one hand, the combustion-active compound material of the detonation wave guide achieves a broadly fanned incendiary effect in the immediate vicinity of the target, and, on the other hand, the incendiary effect of the hollow charge can even be further increased in that the detonation wave guide has additionally arranged thereon a very effective hollow charge cladding made out of a binding material that is incendiary or combustion-active, whereby the incendiary penetration effect of the hollow charge itself is significantly increased.

BRIEF DESCRIPTION OF THE DRAWING

With these and other objects in view, which will become apparent in the following detailed description, the present invention, which is shown by example only, will be clearly understood in connection with the accompanying drawing, in which.

DETAILED DESCRIPTION

Figure 1:
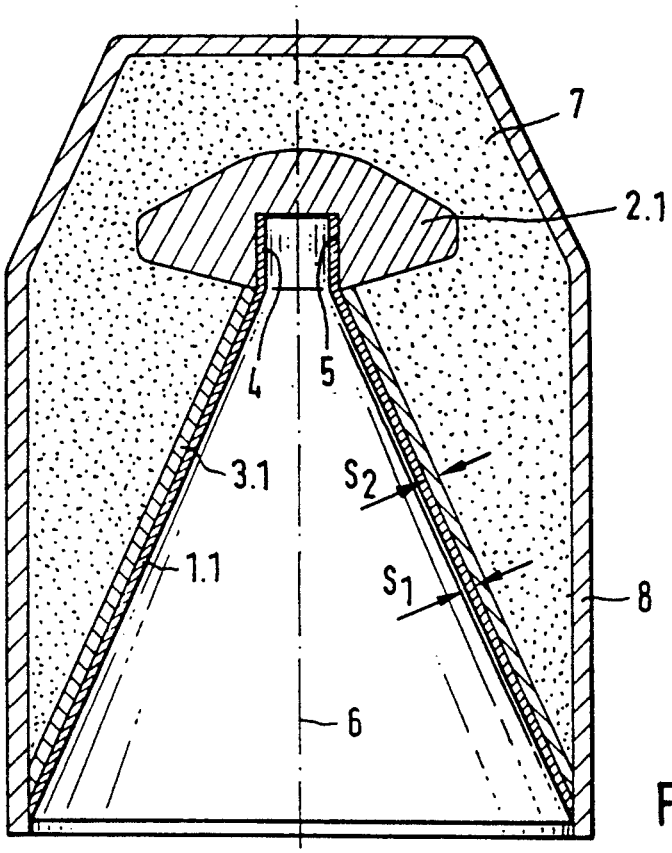
FIG. 1 is a schematic longitudinal sectional view of a hollow charge projectile having an incendiary-active-detonation wave guide which is centered on the hollow charge cladding.
Figure 2:
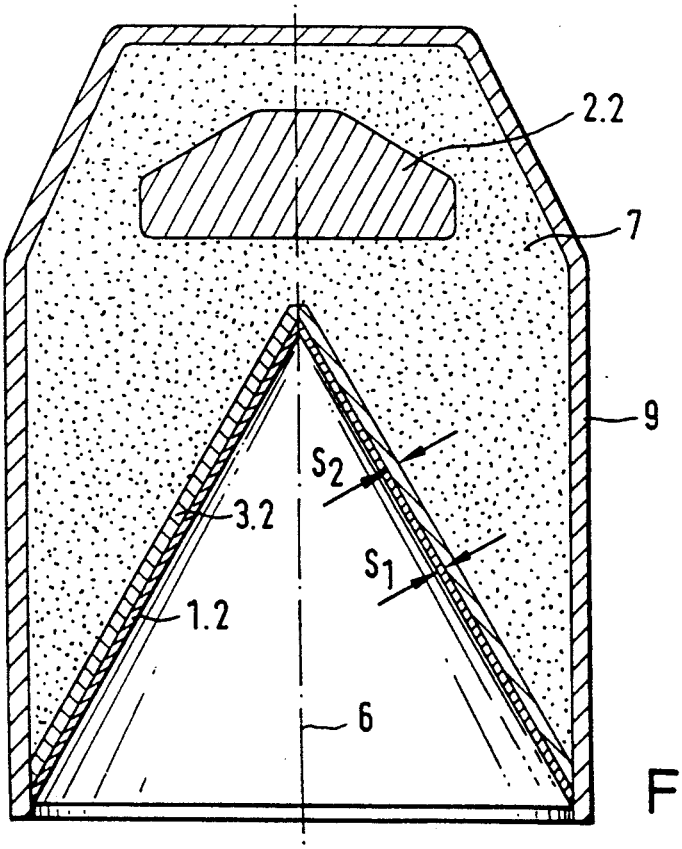
FIG. 2 is a longitudinal sectional view of a further hollow charge projectile in which the incendiary-active-detonation wave guide is embedded into the detonating charge.

FIGS. 1 and 2 illustrate respectively rotational-symmetrical hollow charge claddings 1 with a detonation wave guide 2 coaxially arranged on the rotational axis 6 of the warhead. FIG. 1 illustrates the arrangement of an incendiary-active-detonation wave guide 2.1 preferably in the form of an armor-penetrating bomblet 8 which is adapted to be expelled in great numbers from a non-illustrated large-caliber projectile. The arrangement of FIG. 2 includes an incendiary-active-detonation wave guide 2.2 mounted within a large-caliber armor-piercing projectile 9.

The detonation wave guides 2.1, 2.2 consist of a compound-material which is incendiary-active. This incendiary-active material is enclosed in a metal matrix consisting of metal particles and gas. The metal particles consist of metals having a high combustion enthalpy preferably titanium, zirconium, magnesium, aluminum etc. The matrix consists of an organic polymer, preferably of a carbohydrate material containing oxygen, fluorene and chlorine such as polymethalacrilate, polyester, polyvinylchloride etc. Under certain conditions this binder material is capable of achieving a high incendiary-active effect.

The incendiary-active effect of the binder material is produced at the detonation wave guides 2.1, 2.2 in that the shock waves which are formed during the detonation of the explosive material decompose the matrix and simultaneously heat the metal particles above their ignition temperature, whereby the chemical reaction of the metal particles with the polymer forming the matrix is released, which causes the formation under strong temperature development of metal-carbides, metal-oxides, metal-nitrites, metal-fluorides, metal-sulfides etc. The reaction products which burn at detonation in the air continue to burn in the air by releasing high heat energy so that poorly flammable substances, for example Diesel fuel in vehicles, can be combusted.

The time of burning can be varied in accordance with the size of the metal particles. For example it is sometimes appropriate to provide the binding substance for the detonation wave guides 2.1, 2.2 with relatively coarse metal particles, thereby making available for a sufficient time a broadly fanned incendiary effect in the target.

In order to improve the combustion-active penetration effect at the target it is advantageous to arrange at the combustion-active detonation wave guide 2.1, 2.2 a combustion-active binding substance consisting of a layer 3. As a result of the heterogeneous construction of the binding substance it is, for purposes of producing a uniform shock wave influence necessary that the layer 3 includes fine metal particles. The wall thickness $S_1$ of the hollow charge cladding 1.1, 1.2 corresponds to the layer thickness $S_2$ of the layer 3.1, 3.2, whereby an optimum relationship between penetration capacity of the hollow charge and incendiary effect at the target is attained.

As a result of the binding substance becoming only incendiary-active after being stimulated by shock waves, the arrangements of the invention have a very safe handling capacity and temperature stability so that the detonation wave guide 2.1, 2.2 or the layer 3.1, 3.2 can be for example manufactured in various shapes by means of a shavings-less or splinter-less pressing process.

The detonation wave guide 2.1 has at the front side thereof along the rotational axis 6 a blind bore 5 for a precise centering relative to the hollow charge cladding 1.1. In view of the fact that the detonation wave guide 2.1 is directly arranged on the stump 4 of the conical point of the hollow charge cladding 1.1, there is achieved in addition to the incendiary effect a high degree of precision of the detonation wave guide and thereby optimum spike formation with a high penetration capacity.

With a large caliber hollow charge projectile 9 there should, for example, as a result of spatial conditions, the incendiary-active detonation wave guide 2.2 is rotationally-symmetrically be arranged within the explosive material 7.

The incendiary-active layer 3.1 of the hollow charge cladding 1.1 can, according to FIG. 1, extend up to the detonation wave guide 2.2 or completely encompass the hollow charge cladding 1.2 in the region of the explosive material 7 as is shown in FIG. 2, whereby other variations of the layer 3 are also possible.

Although a limited number of embodiments of the invention have been illustrated in the accompanying drawings and described in the foregoing specification, it is to be especially understood that various changes, such as in the relative dimensions of the parts, materials used, and the like, as well as the suggested manner of use of the apparatus of the invention, may be made therein without departing from the spirit and scope of the invention, as will now be apparent to those skilled in the art.

I claim:

1. A hollow charge device having detonation wave guide means which include incendiary-active means encased in a metal matrix, wherein said detonation wave guide means is formed by a binder which essentially consists of combustion-active metallic material and gas and of a matrix which includes metal particles and gas.

2. The hollow charge device as set forth in claim 1, wherein a) said metal particles are made of metals having a high combustion enthalpy, said metals being selected from the group of titanium, zirconium, magnesium and aluminum; and b) said matrix consisting of an organic polymer selected from the group of polymers of oxygen-, fluorene- and chlorine-containing carbohydrates.

3. The hollow charge device as set forth in claim 2, wherein said carbohydrate polymers are selected from the group polymethacrylate, polyester and polyvinyl chloride.

4. The hollow charge device as set forth in claim 3, wherein said hollow charge has a spike which is covered with a cladding, a layer of a flamable binding substance being substantially coextensive with said cladding.

5. The hollow charge device as set forth in claim 4, wherein said detonation wave guide means include coarse metal particles and said layer of flamable binding substance includes fine metal particles.

6. The hollow charge device as set forth in claim 5, wherein said layer has a first wall thickness and said cladding has a corresponding second wall thickness.

* * * * *